US009198518B1

(12) United States Patent
Mayer

(10) Patent No.: US 9,198,518 B1
(45) Date of Patent: Dec. 1, 2015

(54) AQUATIC SPORT ASSISTANCE DEVICE

(71) Applicant: Donald J. Mayer, Bellevue, WA (US)

(72) Inventor: Donald J. Mayer, Bellevue, WA (US)

( * ) Notice: Subject to any disclaimer, the term of this patent is extended or adjusted under 35 U.S.C. 154(b) by 0 days.

(21) Appl. No.: 14/614,965

(22) Filed: Feb. 5, 2015

(51) Int. Cl.

| | |
|---|---|
| ***B63C 9/08*** | (2006.01) |
| ***A47C 15/00*** | (2006.01) |
| ***B63B 35/74*** | (2006.01) |
| ***A47C 4/54*** | (2006.01) |

(52) U.S. Cl.
CPC ..... *A47C 15/006* (2013.01); *A47C 4/54* (2013.01); *B63B 35/74* (2013.01)

(58) Field of Classification Search
CPC ..... B63B 35/73; B63B 35/74; B63B 7/08; A47C 15/006; A47C 4/54; A63B 2225/605
USPC ..... 441/129, 130, 132; 434/253
See application file for complete search history.

(56) References Cited

U.S. PATENT DOCUMENTS

| | | | | |
|---|---|---|---|---|
| 3,358,304 | A * | 12/1967 | Esmay | 441/65 |
| 4,480,568 | A * | 11/1984 | Trefethern et al. | 114/61.24 |
| 4,606,728 | A * | 8/1986 | Simpson | 441/66 |
| 4,700,648 | A * | 10/1987 | Trefethern et al. | 114/61.24 |
| 5,171,178 | A * | 12/1992 | Creek et al. | 441/132 |
| 6,168,489 | B1 * | 1/2001 | Huston | 441/130 |
| 6,264,518 | B1 * | 7/2001 | Price | 440/91 |
| 6,491,558 | B1 * | 12/2002 | Myers | 441/130 |
| 7,240,634 | B1 * | 7/2007 | Hoge, Jr. | 114/345 |
| 8,708,706 | B2 * | 4/2014 | Plante | 434/253 |
| 2001/0032574 | A1 * | 10/2001 | Newton et al. | 114/61.1 |
| 2010/0105263 | A1 * | 4/2010 | Churchill et al. | 441/72 |
| 2011/0303139 | A1 * | 12/2011 | Hoge, Jr. | 114/39.26 |

* cited by examiner

*Primary Examiner* — Anthony Wiest
(74) *Attorney, Agent, or Firm* — Puget Patent; Michael Gibbons

(57) ABSTRACT

An aquatic sport assistance device for use in surface water sports. An inflatable device using drop-stitch construction to provide a portable but rigid platform on which a user can sit to learn surface water sports. Two floats at a spaced relation to one another create an open space between the two floats. A deck disposed upon the two floats creates an open space between the seats and the surface of the water. This allows water skis or wake boards to rest below the deck on the surface of the water for a natural sitting position. Can be used with barefoot skiing. Device has three seat pads, allowing for use with water skis and wakeboards, and allowing for use as regular or goofy foot. Handles help a user to proper position for activity chosen. Fins give directional stability, allowing device to be towed directly behind boat or along boat wake.

18 Claims, 9 Drawing Sheets

AQUATIC SPORT ASSISTANCE DEVICE

FIELD OF THE INVENTION

This invention relates generally to aquatic sports and, more specifically, to a device to assist with surface water sports.

BACKGROUND

Water skiing, wake boarding, wake surfing, slalom skiing, and the like can be difficult for beginners to master. Each sport relies on the participant traveling at a high speed to cause the ski(s), board, or feet to glide on the water, but the participant must inherently start from a still position. The still position traditionally entails a "deep water start," in which the skier/rider may be mostly submerged for a long period before the tow boat begins to pull the participant via the tow rope. For new participants, the deep water start may be a barrier to participation due to a beginner's natural inability to manage and coordinate the water skis, wake board, or surf board during the initial pull of the rope.

For example, the ability to bend or flex one's legs into a position that allows the rider to be in the proper position for a deep water start may be an impediment to learning. The transition from still to gliding on the water requires physical strength, endurance, and balance, and lack of sufficient strength or coordination may also impede beginners' success. Participants who lack these may be injured and/or may fall before a successful transition from being at rest to planing or gliding on the water. Further, repeated attempts are almost always necessary for a beginner to obtain the kinesthetic sense and muscle memory required to smoothly get up out of the water.

Unfortunately, an uncoordinated attempt at transitioning can result in frustration and/or the aforementioned injury. Past injuries have included pulled, torn, or ruptured musculature, including back muscles, biceps, and hamstrings, for example. These injuries may be aggravated or be more likely when the participant is immersed in cold water, which negatively impacts flexibility and the ability of the muscles to respond well to the force of being pulled by the tow boat.

Accordingly, learning to transition from the deep water start to gliding on the water, even for those with the requisite physical ability or those who are natural "quick studies," can be challenging, injurious, frustrating, and/or time-consuming. A beginner's typical inability to manage and coordinate the water skis, wake board, or surf board while in the water before and during the initial pull of the rope impacts the participant's motivation to continue the learning process. Frustration may even result merely from being in the water for an extended length of time.

Past attempts at such a solution have several issues. One past attempt is composed of solid material, making the device heavy and unwieldy. It also relies on a single inclined seat to create the necessary force on the device, increasing the risk of injury and detracting from the comfort and functionality for the user. Another past attempt relies on a construction that causes heightened hydrodynamic drag, giving the user an inaccurate perception of the forces required to ski without the device. The foregoing devices also include significant limitations on the weight of a rider that may be accommodated (and certainly would not accommodate a rider and an instructor seated together). Finally, many prior attempts are limited to water skiing and have no provision for any other aquatic sport such as wakeboarding (the fastest growing surface water sport). These are just some of the issues with previous attempts which are overcome by the present invention.

SUMMARY OF THE INVENTION

The aquatic sport assistance device disclosed herein provides a stable, practical solution, giving beginners the opportunity to learn aquatic sports according to their own ability. Being able to sit out of the water and be towed slowly prior to the start to get the feel of how the moving water affects the ski or board is helpful and reassuring to the rider. New participants to the sport benefit from being able to "get up" on water skis, for example, more quickly in their own learning process.

Accordingly, new participants may find that they can enjoy the activity sooner after taking it up than without the present invention, ensuring they are more likely to continue. This is so not only for beginners, but also for occasional participants who are out of shape or overweight. The device greatly expands the range of abilities and fitness level of participants who can enjoy water sports while simultaneously creating a safe and easy learning environment for them. It even facilitates an instructor calmly providing verbal guidance during the startup by riding along with the beginner on the device if needed, rather than the instructor having to shout directions from the back of the tow boat to an immersed skier.

The device may also extend the time of year during which water sports may be practical, even for those who are experienced. Through its use, the participant does not have to be immersed in water for the deep water start. Accordingly, at times of year when the water would normally be too cold for water sports due to the water temperature, users could still water ski, for example, knowing that staying relatively dry and/or not wearing a wetsuit is a realistic possibility.

Further, the hydrodynamic characteristics particular to this device, and not present in previous attempts, result in much less drag when pulling a skier or wakeboarder from a starting position on the device than when towing someone who is in the water and to a speed at which the participant can stand up. This facilitates towing of skiers and/or wakeboarders with boats that have much less horsepower than the typical ski or wakeboard boat. The device has been tested with a slalom ski behind a boat with only a 15 hp outboard, for example. Accordingly, the device expands the range of boat types behind which one can ski and wakeboard behind, increasing the number of people who could participate.

The aquatic sport assistance device disclosed herein is a practical means for providing a safe and easy learning environment in which beginners of all types can learn surface water sports, doing so while overcoming all issues seen with past attempts to provide such a device. Other benefits, such as extending the season in which water sports are practical or making water skiing and other water sports possible with less expensive or elaborate tow boats, are also present. The foregoing statements are intended to be non-limiting in nature; additional features, functionality, and benefits will be apparent from other teachings herein.

The invention is comprised essentially of at least one seat and at least one float. In some embodiments, the at least one float may be comprised of an inflatable chamber. In some embodiments, the at least one float may be configured to maintain its form under the weight of a user. In some embodiments, the at least one float may be comprised of a drop-stitch material or otherwise made with a drop-stitch construction. In some embodiments, the at least one float may be a sponson. In some embodiments, the at least one float may have a forward end and an aft end. In some embodiments, the aft end may be a transom. In some embodiments, the aft end may be substantially vertical. In some embodiments, the aft end may be configured to minimize hydrodynamic drag. In some embodiments, the at least one float may be comprised of a bottom, top, two substantially vertical sides, and an aft end. In a further embodiment, the bottom may be substantially flat. In some embodiments, the bottom piece may be substantially flat at the aft end and curved at the forward end to meet the top piece. In some embodiments, the radius between the bottom and the aft end may be configured to minimize hydrodynamic drag. In some embodiments, the aft end may be substantially perpendicular to the bottom. In some embodiments, the float may be comprised of a fin. In some embodiments, the fin may be at the aft end of the float. In some embodiments, the fin may be aligned longitudinally with the float, from aft to forward. In some embodiments, the fin may be configured to provide directional stability for the float.

In some embodiments, the device may be comprised of two floats. In some embodiments, the two floats may be identical. In other embodiments, the two floats may be different. In some embodiments, the two floats may be parallel to each other. In some embodiments, the two floats may be at a fixed distance between one another. In some embodiments, the two floats may be at a spaced relation to one another.

In some embodiments, the at least one seat may be disposed on at least one deck. In some embodiments, the deck may be comprised of an inflatable chamber. In some embodiments, the deck may be configured to maintain its form under the weight of a user. In some embodiments, the inflatable chamber may be comprised of a drop-stitch material or otherwise made with a drop-stitch construction. In some embodiments, the deck may have a forward end and an aft end. In some embodiments, the forward end may extend over the at least one float. In some embodiments, the forward end may extend over two floats. In some embodiments, the deck may be comprised of a substantially u-shaped area as seen from the top. In some embodiments, the aft end may be substantially square. In some embodiments, the aft end may be substantially round. In some embodiments, the deck may be disposed over the two floats to define an open space between the deck and the surface of the water.

In some embodiments, the at least one seat may be comprised of a non-slip material. In some embodiments, the at least one seat may be comprised of a material that has been roughened to create friction between the user and the seat. In some embodiments, the device may include a plurality of seats. In some embodiments, the device may include three seats. In an exemplary embodiment, the device may have one seat pad disposed at the aft end of the deck, and one over each of two floats.

In some embodiments, the device may include at least one handle. In some embodiments, the at least one handle may be disposed to guide a user to a proper position on the device. In some embodiments, the device may include a set of two handles. In a further embodiment, the set of two handles may be disposed to guide a user to a proper position. In some embodiments, the device may include two sets of handles, each set disposed to guide a user to a proper position on one of three seats on the device.

In addition to the foregoing, various other methods, systems and/or program product embodiments are set forth and described in the teachings such as the text (e.g., claims, drawings and/or the detailed description) and/or drawings of the present disclosure.

The foregoing is a summary and thus contains, by necessity, simplifications, generalizations and omissions of detail; consequently, those skilled in the art will appreciate that the summary is illustrative only and is NOT intended to be in any way limiting. Other aspects, embodiments, features and advantages of the device and/or processes and/or other subject matter described herein will become apparent in the teachings set forth herein.

BRIEF DESCRIPTION OF THE DRAWINGS

Certain embodiments of the present invention are described in detail below with reference to the following drawings.

DETAILED DESCRIPTION

This invention relates generally to aquatic sports and, more specifically, to a device to assist with surface water sports. Specific details of certain embodiments of the invention are set forth in the following description and in FIGS. 1-11 to provide a thorough understanding of such embodiments. The present invention may have additional embodiments, may be practiced without one or more of the details described for any particular described embodiment, or may have any detail described for one particular embodiment practiced with any other detail described for another embodiment.

Importantly, a grouping of inventive aspects in any particular "embodiment" within this detailed description, and/or a grouping of limitations in the claims presented herein, is not intended to be a limiting disclosure of those particular aspects and/or limitations to that particular embodiment and/or claim. The inventive entity presenting this disclosure fully intends that any disclosed aspect of any embodiment in the detailed description and/or any claim limitation ever presented relative to the instant disclosure and/or any continuing application claiming priority from the instant application (e.g. continuation, continuation-in-part, and/or divisional applications) may be practiced with any other disclosed aspect of any embodiment in the detailed description and/or any claim limitation. Claimed combinations which draw from different embodiments and/or originally-presented claims are fully within the possession of the inventive entity at the time the instant disclosure is being filed. Any future claim comprising any combination of limitations, each such limitation being herein disclosed and therefore having support in the original claims or in the specification as originally filed (or that of any continuing application claiming priority from the instant application), is possessed by the inventive entity at present irrespective of whether such combination is described in the instant specification because all such combinations are viewed by the inventive entity as currently operable without undue experimentation given the disclosure herein and therefore that any such future claim would not represent new matter.

Figure 1:
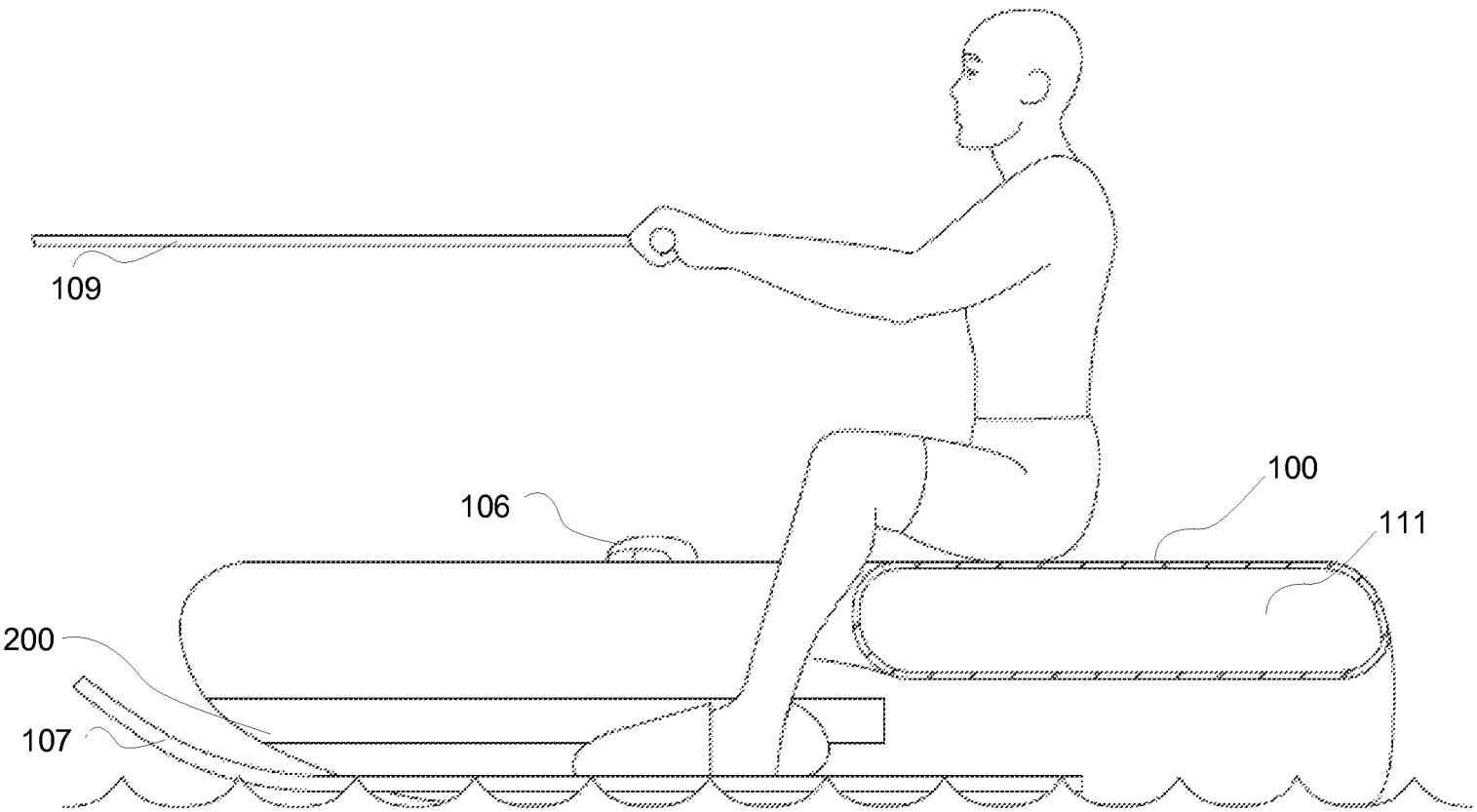
FIG. 1 is a cutaway side view of the aquatic sport assistance device, showing the device with water skis.

FIG. 1 is a cutaway view of a primary function of the aquatic sport assistance device as used with a water ski 107 and a tow rope 109. The aquatic sport assistance device as depicted in FIG. 1 has a deck 100 and a float 200. Float 300 is not shown due to the cutaway plane, but is visible in FIG. 8 which is an isometric view of the device. Deck 100 as depicted is comprised of at least one inflatable chamber 111. It should be noted that even though the aquatic sport assistance device is inflatable, and therefore deflatable, FIG. 1 does not show any distortion in the surface of the deck. Accordingly, the present invention combines the manageability and portability of an inflatable device with the support of a rigid device.

FIG. 1 also shows the front handles 106. In some embodiments, the aquatic sport assistance device has one pair of handles. In some embodiments, the aquatic sport assistance device has two pairs of handles. The handles, to be illustrated more completely herein, help to place the user in the proper position for use of the aquatic sport assistance device. When the user is in the proper position, the skis 107 go under deck 100 and between floats 200 and 300 (float 300 not visible due to the cutaway plane but visible in FIG. 8), allowing the user to sit above the skis while the skis float on or skim the surface of the water.

Figure 2:
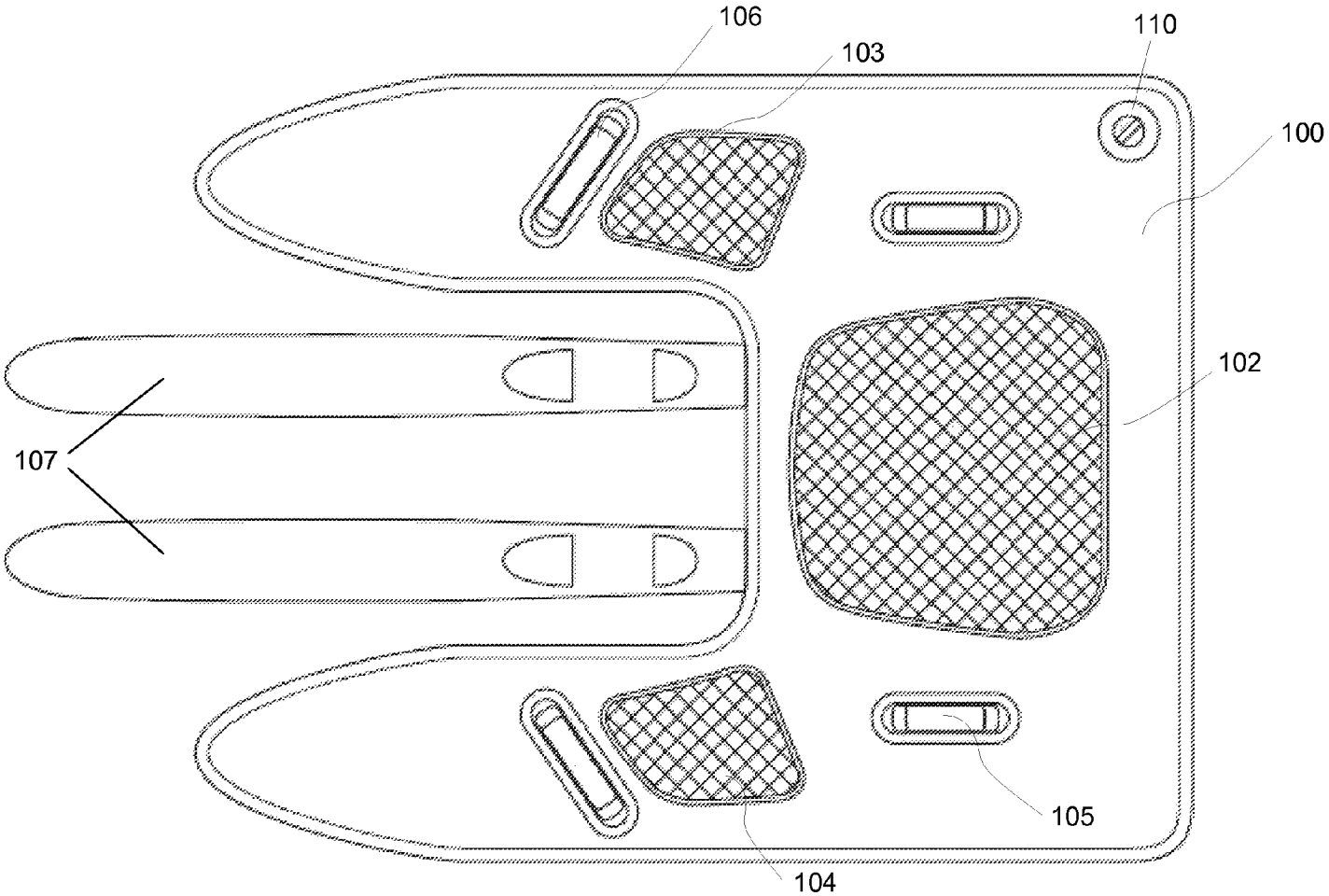
FIG. 2 is a top view of the aquatic sport assistance device, showing the device with water skis.

FIG. 2 is a top view of the aquatic sport assistance device as used with water skis. Here the entire deck 100 (i.e. without being cut away) can be seen in one exemplary embodiment. In this embodiment, the deck 100 is a substantially u-shaped deck wherein the front or forward prongs extend over floats 200 and 300 (floats not visible in FIG. 2 but visible in FIG. 8), and wherein the back or aft portion is substantially square. FIG. 2 depicts the forward portion of deck 100 as shaped such that aerodynamic and/or hydrodynamic drag is reduced, allowing the device to travel more freely with the user's body.

FIG. 2 also shows seat pad 102. Seat pad 102 is the location upon which a user sits to use the aquatic sport assistance device with water skis or as a barefoot skier. Seat pad 102 is designed to allow the weight of the user to create friction with the aquatic sport assistance device, pulling the device with the user as the user holds onto the tow rope 109, as seen in FIG. 1. In some embodiments, seat pad 102 may be a tacky material, such that the seat pad tends to cling to the user in a mechanical fashion, as opposed to an adhesive manner. In some embodiments, seat pad 102 may be a high friction material, like neoprene, ethylene-vinyl acetate foam, or polyurethane gel. In some embodiments, seat pad 102 may be some material that has been roughened to create a higher friction surface. Other materials could be used to create friction with the user's body without altering the function of seat pad 102. FIG. 2 also depicts seat pads 103 and 104, each disposed on one of the forward prongs of deck 100. In some embodiments, seat pads 102, 103, and 104 may be the same material. In some embodiments, seat pads 102, 103, and 104 may be different materials. In some embodiments, the aquatic sport assistance device may have only one seat pad, which could be any of seat pad 102, 103, or 104. In some embodiments, the device may have only two seat pads, which may be any combination of seat pads 102, 103, and 104. In some embodiments, the device may have all of seat pads 102, 103, and 104. In some embodiments, the device may have more seat pads in addition to seat pads 102, 103, and 104.

In some embodiments, the device may have two or more seat pads in the center of the deck 100, whereby two or more riders could sit on the device and get up simultaneously. In other embodiments, the single seat pad 102 is sized to accommodate one rider, two riders, or more. In some embodiments, the deck is sized such that a rider may sit in the lap of another person, such as a teacher.

Next to and slightly forward of seat pad 102 are handles 105. In this embodiment, handles 105 are used to properly position a user on seat pad 102. FIG. 2 also shows seat pads 103 and 104. In front of each seat pad 103 and 104 is one handle of the handle pair 106. In this embodiment, a user grips right handle 106 and right handle 105 to be properly positioned on seat pad 103. Conversely, a user grips left handle 106 and left handle 105 to be properly positioned on seat pad 104. This will be discussed further herein. Additionally, the handles may be used to pull the device out of the water from the tow boat, or for easy carrying of the device when out of the water.

FIG. 2 also depicts valve 110 on deck 100. Valve 110 is the valve used to inflate and deflate deck chamber 111, as shown in FIG. 1. In some embodiments, valve 110 may be a high pressure valve. In some embodiments, valve 110 may be a check valve or duckbill valve, allowing air to flow in only one direction during inflation and only one direction during deflation. In some embodiments, valve 110 may have a lid that is coupled with the valve via screws. In some embodiments, the lid may snap to valve 110. In some embodiments, the lid may push into valve 110. In some embodiments, valve 110 may be rigid. In other embodiments, valve 110 may be flexible. Valve 110 may be polyurethane, rubber, metal, plastic, or any other material from which valves are usually made.

Finally, FIG. 2 depicts how the aquatic sport assistance device is used with water skis 107. It should be noted that, while two skis are depicted, the aquatic sport assistance device can be used with a single ski, such as a slalom ski. Water skis 107 fit between floats 200 and 300, not depicted, and between the surface of the water and the bottom of deck 100. This allows a user to sit properly on seat pad 102 and have skis 107 below the user, so that when the user stands, the user is in a properly balanced position and already traveling at an appropriate speed. Accordingly, the present invention, including the rigidity of deck 100 and the open space below deck 100, allows a user to transition to the standing position almost effortlessly, instead of having to stand from a deep water start (which is the "normal" method) or having to rise off a flexible surface that provides neither sufficient support nor the proper position.

Figure 3:
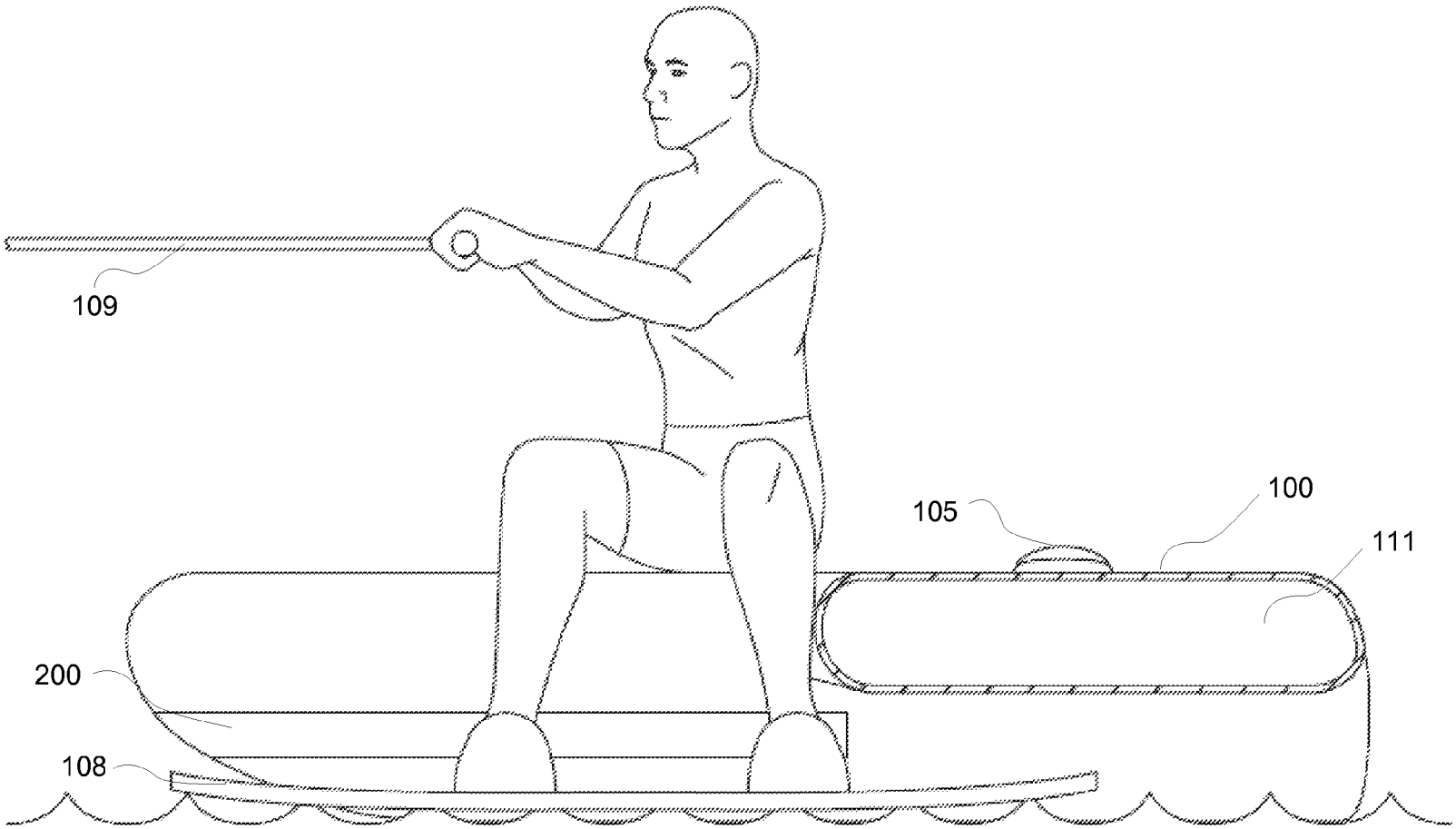
FIG. 3 is a cutaway side view of the aquatic sport assistance device, showing the device with a wakeboard.

FIG. 3 is a cutaway view of another primary function of the aquatic sport assistance device as used with a wake board 108 and a tow rope 109. Again, deck 100, inflatable chamber 111, and float 200 are depicted, whereas float 300 is not shown due to the cutaway plane. Once again, FIG. 3 does not show any distortion in deck 100 or in chamber 111, as the aquatic sport assistance device is designed to provide a rigid yet inflatable support for the user.

FIG. 3 depicts handles 105 instead of 106. As discussed above, a user can be properly positioned on seat pad 103, depicted, or 104 by gripping one handle 105 and one handle 106, not seen due to position of user. The present invention can be used by wakeboarders or wake surfers in either the regular or "goofy" position. As depicted in FIG. 3, a user is using the aquatic sport assistance device with a wakeboard in the goofy position.

Figure 4:
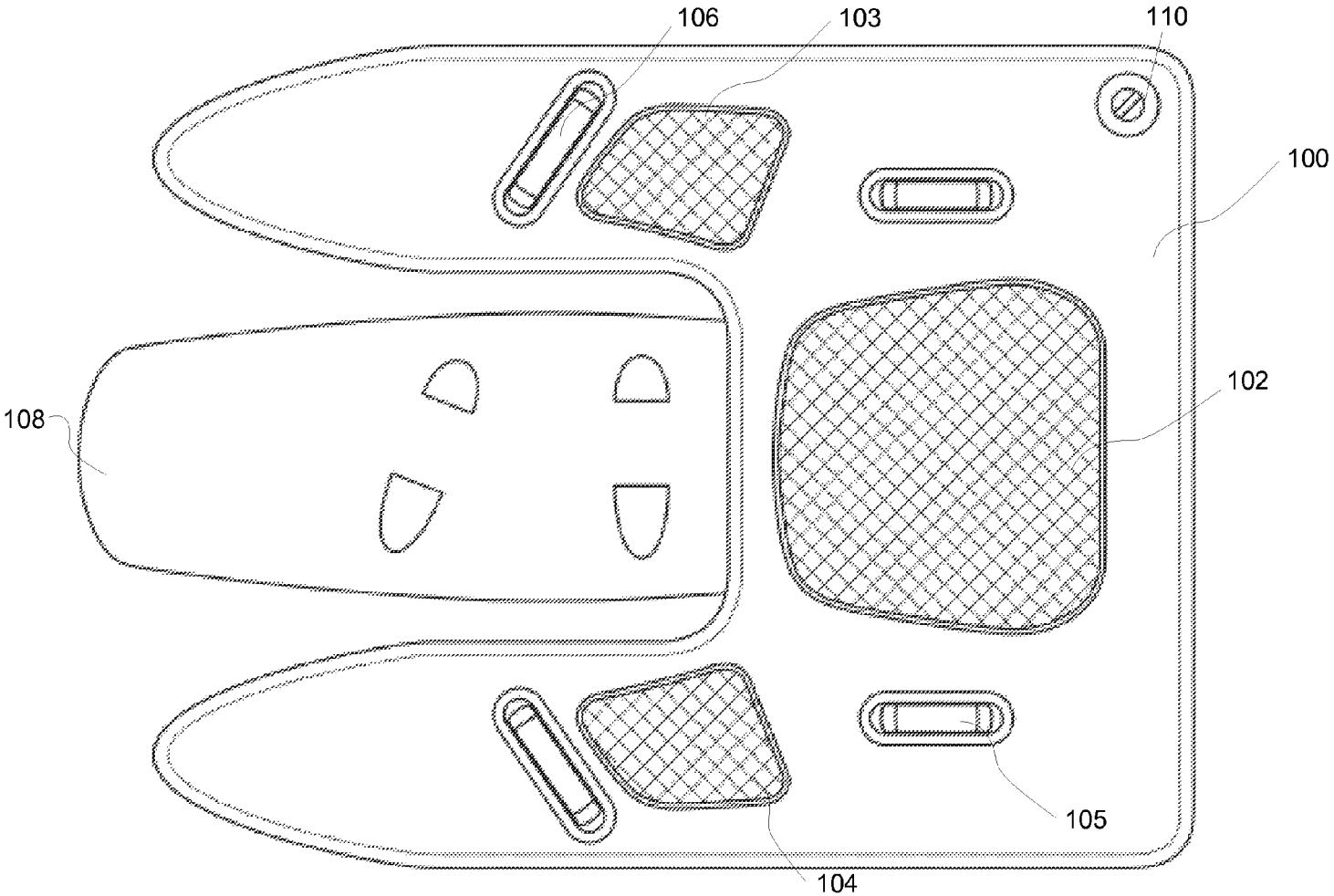
FIG. 4 is a top view of the aquatic sport assistance device, showing the device with a wakeboard.

FIG. 4 is a top view of the aquatic sport assistance device as used with a wakeboard 108. Again, entire deck 100 can be seen in an exemplary embodiment. When using the aquatic sport assistance device with a wakeboard, a user will select either regular or goofy position. To use the device in the goofy position, a rider would grip right handle 105 and right handle 106 to lower onto seat pad 103, with the user's feet on wakeboard 108. To use the device in standard position, a user would grip left handle 105 and left handle 106 to lower onto seat pad 104, with feet on wakeboard 108. In some embodiments, the handles may be a rigid or semi-rigid plastic material. In some embodiments, the handles may be a rigid or semi-rigid rubber material. The handles may in fact be any number of rigid or semi-rigid materials, so long as the material maintains its shape and position, without altering the function of the handles.

Figure 5A:
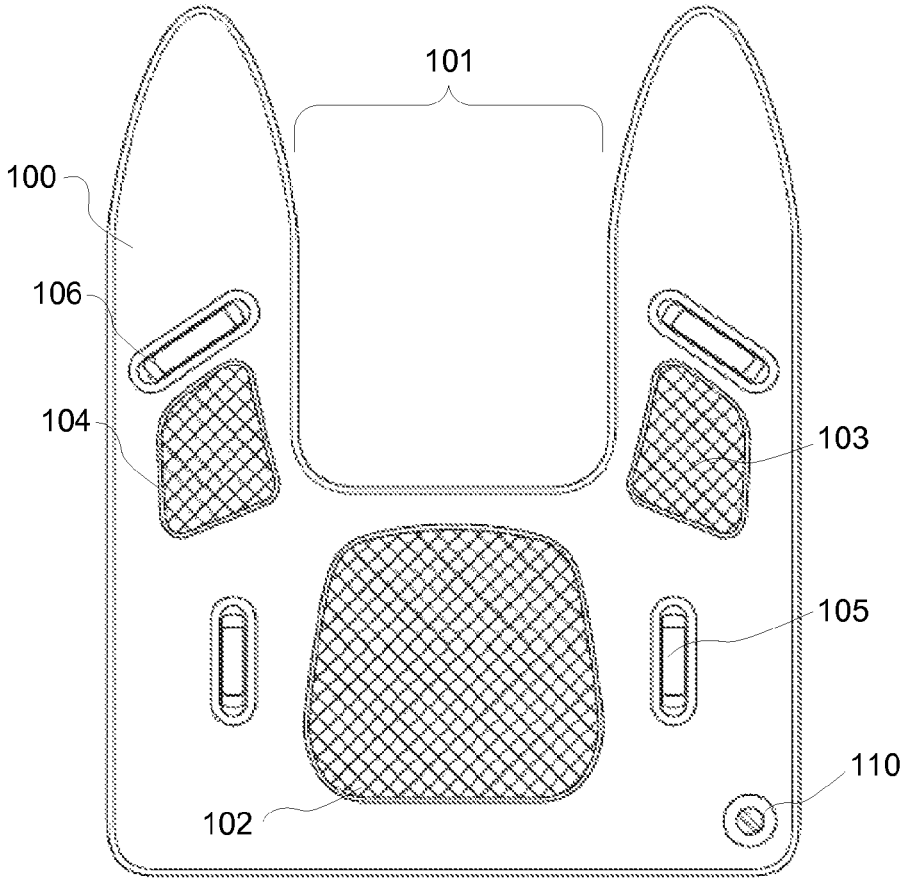
FIG. 5*a* is a top view of the aquatic sport assistance device.
Figure 5B:
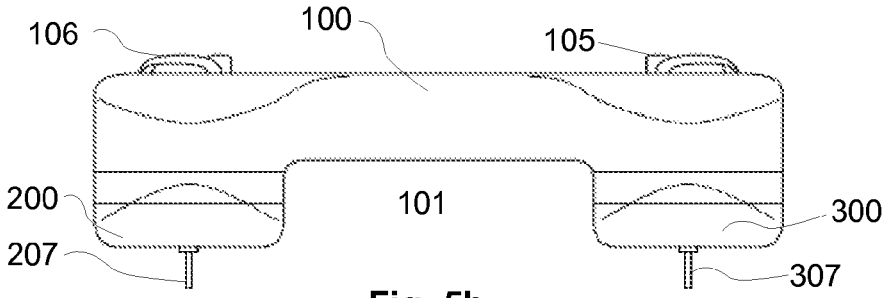
FIG. 5*b* is a front view of the aquatic sport assistance device.

FIG. 5*a* is a top view of one embodiment of the aquatic sport assistance device, showing deck 100, handles 105 and 106, seat pads 102, 103, and 104, and valve 110. FIG. 5*a* also shows open space 101, created by the two prongs of deck 100 and the floats situated below them. FIG. 5*b* is a front view of the aquatic sport assistance device. This view shows floats 200 and 300, as well as handles 105 and 106 and the open space 101. As depicted, float 200 has fin 207 coupled with it at the aft end of the float and float 300 has fin 307 coupled with it at the aft end of the float. In some embodiments, both floats may have a fin. In some embodiments, only one float may have a fin. In some embodiments, there may be no fins. In some embodiments, there may be multiple fins per float. In some embodiments, fins may be at the center of the floats. In some embodiments, fins may be at the outside or inside edge of the floats. In some embodiments, fins may be coupled at the forward end of the float. In some embodiments, fins may be coupled near the middle of the float. In some embodiments, fins may be distributed along the length of the float.

Figure 5C:
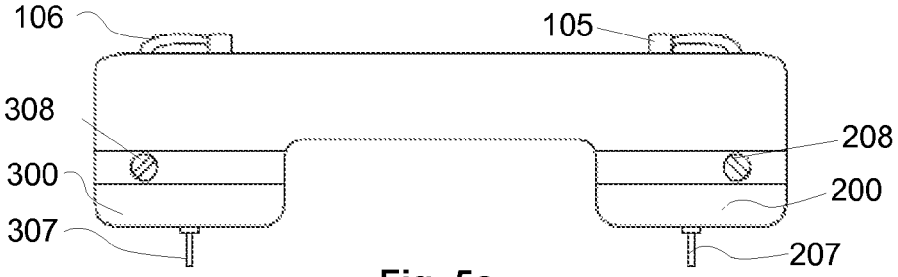
FIG. 5*c* is a rear view of the aquatic sport assistance device.

FIG. 5*c* is a rear view of the aquatic sport assistance device. Float 200 has a valve 208, and float 300 has a valve 308. With FIGS. 5*b* and 5*c*, it can be seen that fins 207 and 307 are disposed in the longitudinal direction of the floats. In any embodiment with at least one fin, the fin or fins are configured to provide directional stability of the aquatic sport assistance device, meaning that the fin or fins are disposed in the direction of travel. This lends to the general stability of the device, further aiding the user, because the aquatic sport assistance device travels steadily in the direction in which it is being towed, rather than being subjected to the currents and wakes that might otherwise allow the aquatic sport assistance device to become erratic. This allows the device to be towed directly behind a tow boat. The fin configuration also allows the device to be towed behind a tow boat but, instead of directly behind it, at an angle to it, such as along the wake. Because the fins provide directional stability, the aquatic sport assistance device can be towed along a wake of the boat, again allowing it to be used for wake boarding or wake surfing.

Figure 6:
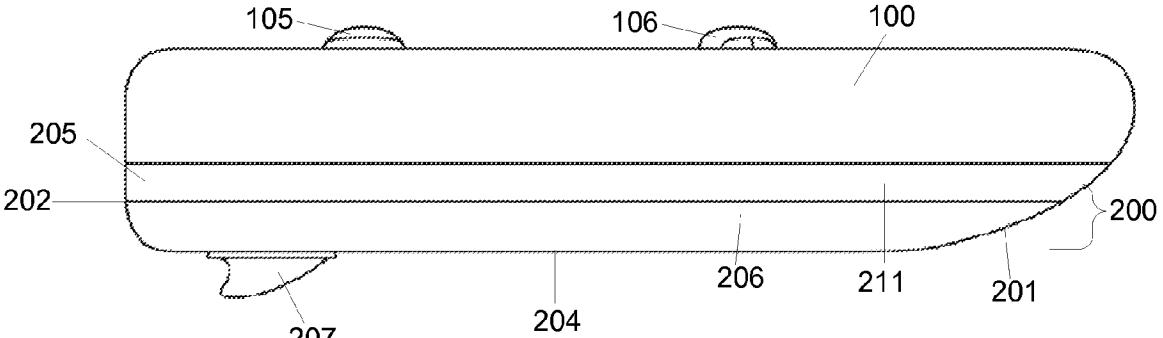
FIG. 6 is a side view of the aquatic sport assistance device.

FIG. 6 is a side view of deck 100 and float 200. In some embodiments, deck 100 may be joined with float 200 at a seam 211. In some embodiments, seam 211 may be exposed. In other embodiments, seam 211 may be covered. As depicted in FIG. 6, seam 211 is covered. In some embodiments, a cover may be primarily cosmetic, and may be constructed of any manner of flexible material without altering the function of the cover.

In some embodiments, float 200 may be a sponson. A sponson is a curved, air-filled float configured to minimize aero and hydrodynamic drag. In some embodiments, float 200 may include an inflatable chamber 209 (not shown in FIG. 6, but the opposing inflatable chamber 309 is visible in FIG. 9). In some embodiments, float 200 may be comprised of a bottom portion 204. In some embodiments, bottom portion 204 may be substantially flat. In some embodiments, bottom portion 204 may be substantially flat at the aft end of the float. In some embodiments, bottom portion 204 may be curved at the forward end 201 of the float. In some embodiments, bottom portion 204 may curve to meet top portion 205. In some embodiments, float 200 may have at least one side portion 206. In some embodiments, float 200 may have two side portions 206. In a further embodiment, side portions 206 may be coupled with bottom portion 204 along the longitudinal edges of sides 206 and bottom 204.

In some embodiments, float 200 may have a transom 202, the surface that forms the stern of the device. Notably, the device is inflatable, yet it has a near vertical aft portion. The near vertical transom allows for a minimal hydrodynamic drag. The present invention is configured such that the radius between bottom 204 and transom 202 is minimized to achieve the near-vertical nature of the transom. In a preferred embodiment, transom 202 is substantially perpendicular to bottom portion 204 and to the surface of the water. In some embodiments, the aft surface of deck 100 may be at the same angle as transom 202, namely at a perpendicular angle to the plane of travel and the bottom 204 of float 200.

FIG. 6 also depicts a full image of fin 207, showing that it is disposed in the longitudinal direction of float 200.

As discussed above, in one embodiment, floats 200 and 300 may be identical in construction. The descriptions of the elements in FIG. 6 as applied to float 200 apply to the elements of float 300.

Figure 7:
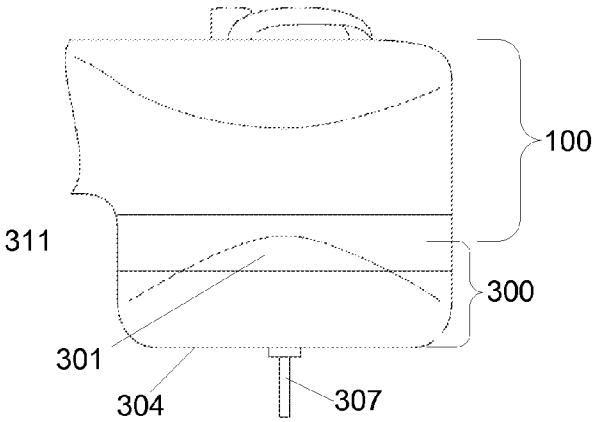
FIG. 7 is a front view of a float of the aquatic sport assistance device.

FIG. 7 is a close up view of float 300. FIG. 7 depicts the shape of the forward portion of the aquatic sport assistance device. Bottom portion 304 is flat, but it curves upward 301 to meet the top portion of the float, which is coupled with deck 100 at seam 311. The embodiment depicted in FIG. 7 has the forward portion of the left prong of deck 100 curving down slightly toward float 300. In this embodiment, the aerodynamic drag is further reduced by the shape of deck 100.

Figure 8:
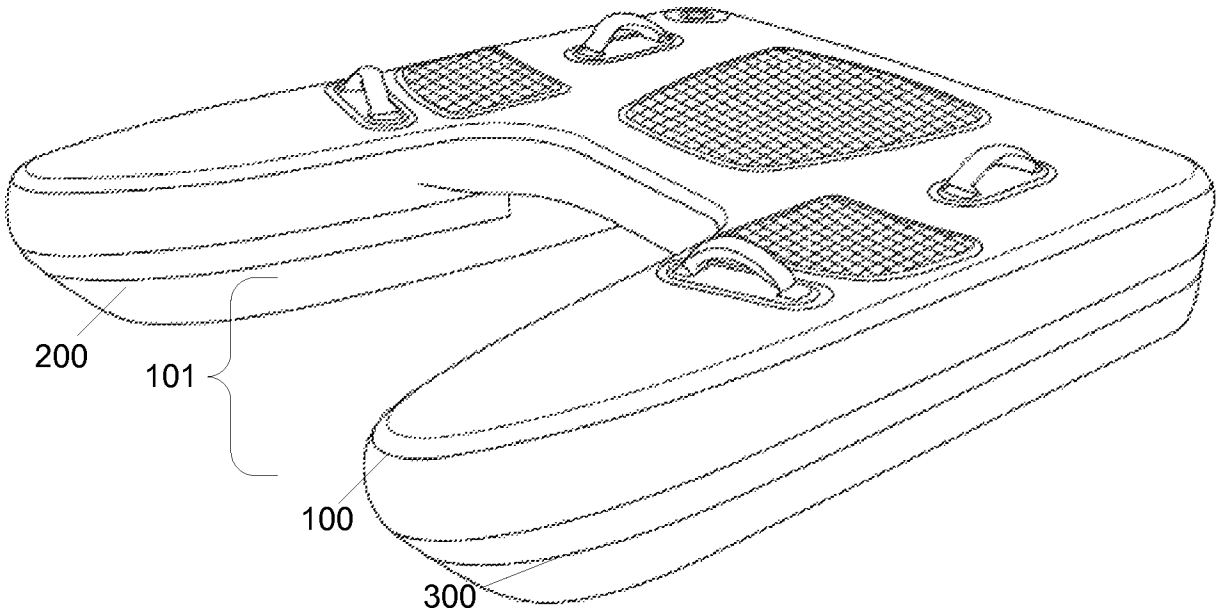
FIG. 8 is an isometric view of the aquatic sport assistance device.
Figure 9:
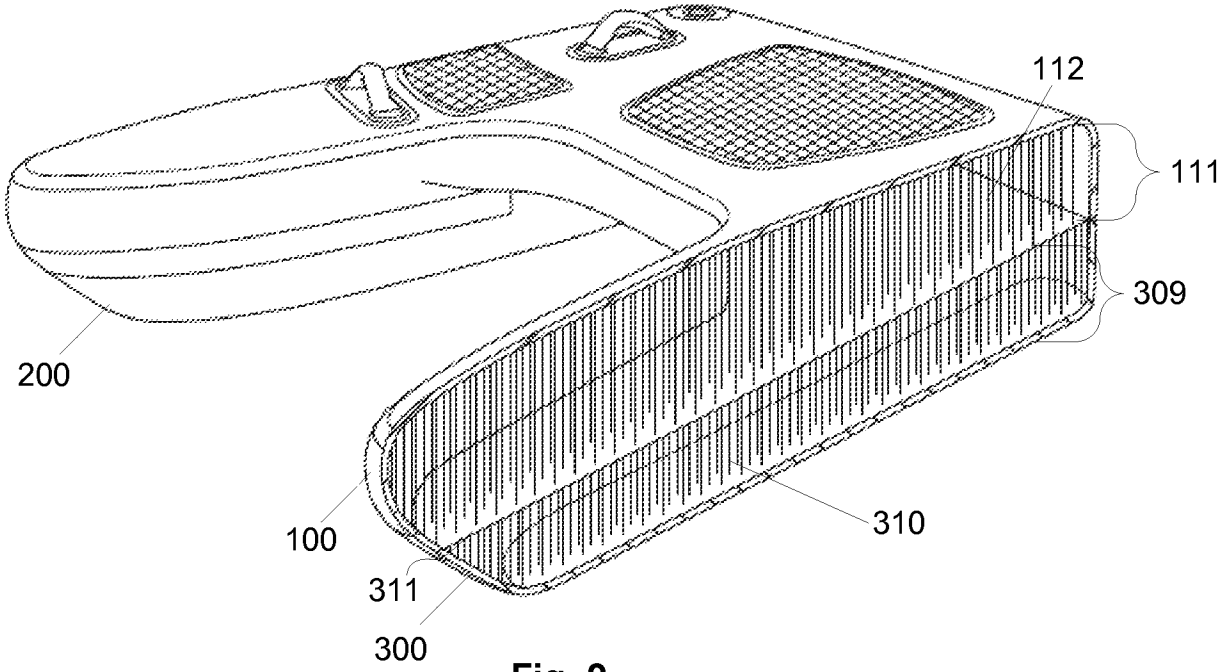
FIG. 9 is an isometric cutaway view of the aquatic sport assistance device, showing the drop-stitch construction of both the deck chamber and the float chamber.

FIGS. 8 and 9 together show the general construction of the aquatic sport assistance device. FIG. 8 is an isometric view of the aquatic sport assistance device showing deck 100, float 200, float 300, and the open space 101. Open space 101 is a vertical and horizontal space created by floats 200 and 300. Open space 101 allows the deck 100 to sit above the surface of the water, creating room for water skis or a wakeboard to rest on the surface of the water in a natural sitting position for the user. This further facilitates the user's rise to the standing position as it is nearly as simple as rising from a chair.

FIG. 9 is a cutaway isometric view of the aquatic sport assistance device. FIG. 9 depicts deck 100, float 200, and float 300. In some embodiments, deck 100 may be comprised of a drop-stitch material or otherwise made with a drop-stitch construction 112. Drop-stitch 112 may be disposed throughout inflatable chamber 111. Drop-stitch construction is a particularly unique construction method which relies on a plurality of cords, threads, or fibers to lend rigidity and stability to an otherwise flexible structure, such as an inflatable chamber. Drop-stitch construction is comprised of a top layer of fabric and a bottom layer of fabric. The plurality of cords, threads, or fibers are distributed throughout the chamber and connected with the top and bottom layers of fabric. When a drop-stitch structure, such as the present invention, is inflated, the structure can withstand fairly heavy loads. This particular structure is what lends to the flexibility of an inflatable device with the rigidity required to allow a user to sit on the device without deformation, as depicted in FIG. 1 and FIG. 3. In some embodiments, the upper and lower layers may be a vinyl material. In some embodiments, the upper and lower layers may be a polymer. In some embodiments, the upper and lower layers may be PVC, polyurethane, or any other flexible material. In all embodiments, the upper and lower layers will be air and water tight. In a preferred embodiment, the upper and lower layers, or the top and bottom of deck 100, will be the same material as the rest of the aquatic sport assistance device.

FIG. 9 also depicts a drop-stitch construction 310 in float chamber 309. Notably, the device is both inflatable and rigid when inflated. Therefore, in some embodiments, both floats 200 and 300 will be comprised of a drop-stitch construction. As with drop-stitch 112 for deck 100, drop-stitch 210, not depicted, and 310 for floats 200 and 300, respectively, consist of a plurality of cords, threads, or fibers coupled with the upper and lower portions of the floats. As above, all descriptions of elements regarding float 300 can be applied to the elements of float 200.

Figure 10:
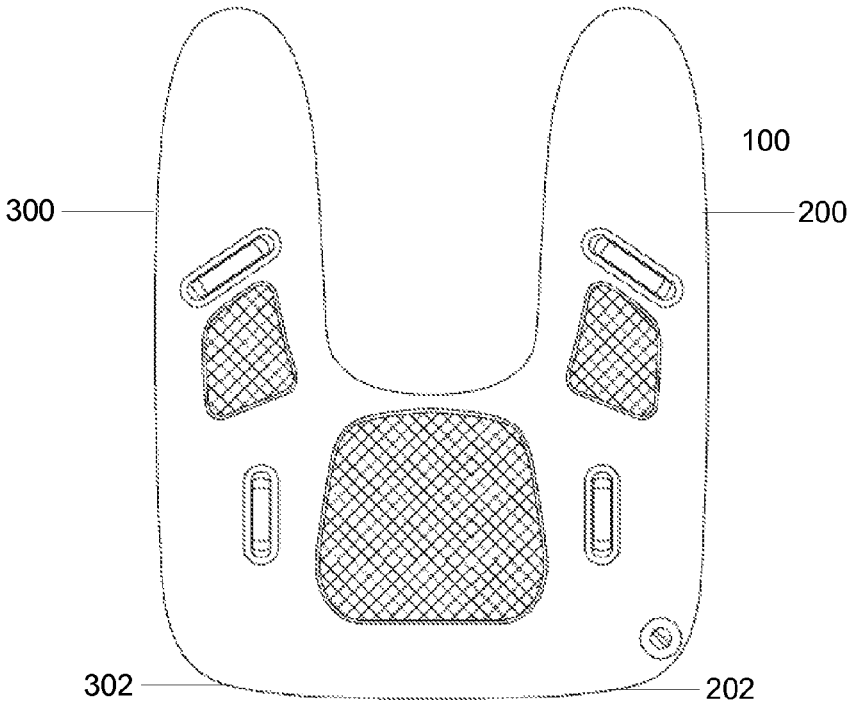
FIG. 10 is a top view of an alternative embodiment of the aquatic sport assistance device.
Figure 11:
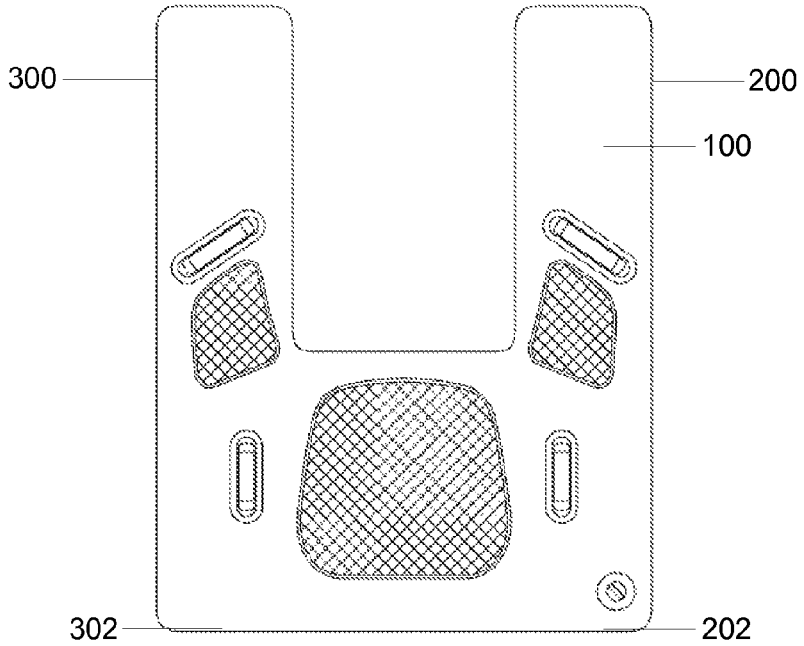
FIG. 11 is a top view of a different alternative embodiment of the aquatic sport assistance device.

FIG. 10 is a top view of one alternate embodiment of the aquatic sport assistance device. In this embodiment, floats 200 and 300 may be slightly rounder, and the aft end of deck 100 may be slightly curved. FIG. 11 is a top view of another alternate embodiment of the aquatic sport assistance device, in which the entire device is of a more rectangular shape. The general shape of the device may vary, but the essential elements discussed herein, such as transoms 202 and 302, will retain their function.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of this subject matter described herein. Furthermore, it is to be understood that the invention is defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.).

While preferred and alternative embodiments of the invention have been illustrated and described, as noted above, many changes can be made without departing from the spirit and scope of the invention. Accordingly, the scope of the invention is not limited by the disclosure of these preferred and alternate embodiments. Instead, the invention should be determined entirely by reference to the claims that follow.

What is claimed is:

1. An aquatic sport assistance device comprising:

at least one deck, further comprising:

at least one inflatable chamber in a substantially u-shaped configuration wherein the aft end is substantially square, the forward end is further comprised of two prongs, and the area between the two prongs is open;

at least one seat pad in the middle of the aft area end of the deck; and at least one handle disposed to guide a user to proper placement on the at least one seat pad; and at least two seat pads disposed on each of the two prongs, the at least two seat pads facilitating use of the device at least for wake boarding, wherein the at least one seat pad in the middle of the aft end of the deck and the at least two seat pads disposed on each of the two prongs include at least a non-slip surface;

at least two floats, each float further comprising:

at least one top portion;

at least one bottom portion with a forward end and an aft end, wherein an aft end is substantially flat and a forward end curves upward to meet the at least one top portion;

at least two substantially vertical side opposing portions joined to the at least one bottom portion along the longitudinal edges of the at least one bottom portion;

at least one transom at the aft end of the at least one bottom portion, the at least one transom substantially vertical, wherein the at least one transom is joined with the at least one top portion, the at least two side portions, and the at least one bottom portion, and wherein the radius between the at least one bottom portion and the at least one transom is configured to minimize hydrodynamic drag; and at least one fin configured to maximize directional stability of the device;

wherein the at least one deck and the at least two floats are constructed with drop-stitch construction;

wherein the at least two floats are substantially parallel and at a spaced relation to one another; and wherein the at least one deck is disposed over the at least two floats to define an open space between the at least one deck and the surface of the water.

2. The device of claim 1, wherein the at least one transom at the aft end of the at least one bottom portion comprises:

at least one transom configured 90 degrees to the surface of the water.

3. The device of claim 1, wherein the at least one fin configured to maximize directional stability of the device further comprises:

at least one fin coupled with the aft end of the at least one float in the longitudinal direction of the at least one float.

4. The device of claim 1, wherein the at least one transom at the aft end of the at least one bottom portion comprises:

at least one transom including at least a bottom trailing edge defined by a substantially perpendicular angle between a bottom surface of the at least one transom and an aft surface of the at least one transom, the substantially perpendicular angle defining a trailing edge configured to minimize hydrodynamic drag.

5. The device of claim 1, wherein the at least one inflatable chamber comprises:

at least one inflatable chamber including at least one valve.

6. The device of claim 5, wherein the at least one inflatable chamber including at least one valve comprises:

at least one inflatable chamber including one or more of at least one check valve or at least one duckbill valve.

7. The device of claim 1, wherein the at least one seat pad in the middle of the aft end of the deck and the at least two seat pads disposed on each of the two prongs including at least a non-slip surface comprise:

at least one seat pad in the middle of the aft end of the deck and at least two seat pads disposed on each of the two prongs, the at least one seat pad in the middle of the aft end of the deck and at least two seat pads disposed on each of the two prongs allowing a weight of a user to create friction with the device.

8. The device of claim 7, wherein the at least one deck comprises:

at least a second handle forward of a seat pad on a first prong and a third handle forward of a seat pad on a second prong.

9. The device of claim 1, wherein the at least one deck comprises:

at least four handles, the at least four handles disposed to guide a user to proper placement on the seat pads.

10. The device of claim 1, wherein the at least one deck comprises:

at least one deck configured to maintain form under a weight of a user.

11. The device of claim 1, wherein the at least two floats comprise:

at least two floats configured to maintain form under a weight of a user.

12. The device of claim 1, wherein the at least one fin configured to maximize direction stability of the device comprises:

at least one fin disposed at the aft end of the float and coupled with the underside of the at least one bottom portion.

13. The device of claim 1, wherein the at least one fin configured to maximize directional stability of the device comprises:

at least one fin disposed at a center of the aft end of the float.

14. The device of claim 1, wherein the at least one seat pad in the middle of the aft end of the deck and the at least two seat pads disposed on each of the two prongs including at least a non-slip surface comprise:

at least one seat pad in the middle of the aft end of the deck and the at least two seat pads disposed on each of the two prongs including at least a portion of the at least one deck that has been roughened to create a higher friction surface.

15. The device of claim 1, wherein the at least two seat pads disposed on each of the two prongs, the at least two seat pads facilitating use of the device at least for wake boarding comprise:

at least two seat pads disposed on each of the two prongs, the at least two seat pads facilitating use of the device at least for wake surfing.

16. The device of claim 1, wherein the at least one handle disposed to guide a user to proper placement on the at least one seat pad comprises:

at least one semi-rigid handle disposed to guide a user to proper placement on the at least one seat pad.

17. The device of claim 1, further comprising:

a cover configured to cover a seam joining the deck and the float.

18. The device of claim 1, wherein the at least one deck and the at least two floats constructed with drop-stitch construction comprise:

at least one deck and the at least two floats constructed with drop-stitch construction including at least top layer of fabric and a bottom layer of fabric connected by at least one of cords, threads, or fibers.

* * * * *